United States Patent [19]

Julius et al.

[11] 4,428,497

[45] Jan. 31, 1984

[54] DISPENSER FOR MOIST TOWELETTES

[75] Inventors: Robert P. Julius, Greenwich, Conn.; William E. Dwan, Yorktown Heights, N.Y.; Albert F. Tullar, Plainfield, Ind.

[73] Assignee: Nice-Pak Products, Inc., Mount Vernon, N.Y.

[21] Appl. No.: 374,613

[22] Filed: May 3, 1982

[51] Int. Cl.[3] ..... B65D 43/14; B65D 51/04

[52] U.S. Cl. ..... 220/339; 220/306; 206/812; 206/210

[58] Field of Search ..... 220/306, 339, 334; 206/210, 812, 1.5; 229/44 R, 45 R; 16/225

[56] References Cited

U.S. PATENT DOCUMENTS

| | | | |
|---|---|---|---|
| 2,935,188 | 5/1960 | Thomas | 206/42 |
| 3,394,861 | 7/1968 | Truax | 229/15 |
| 3,412,890 | 11/1968 | Rich | 220/30 |
| 3,417,897 | 12/1968 | Johnson | 220/60 |
| 3,421,654 | 1/1969 | Hexel | 220/60 |
| 3,458,113 | 7/1969 | Swartzbaugh | 229/44 |
| 3,904,074 | 9/1975 | Hoffman et al. | 220/339 |
| 3,986,479 | 10/1976 | Bonk | 118/506 |
| 3,994,417 | 11/1976 | Boedecker | 221/48 |
| 4,219,129 | 8/1980 | Sedgwick | 221/63 |
| 4,366,915 | 1/1983 | Seidler | 220/339 |

FOREIGN PATENT DOCUMENTS 1319370 1/1963 France .

*Primary Examiner*—George T. Hall

*Attorney, Agent, or Firm*—Gottlieb, Rackman & Reisman

[57] ABSTRACT

A dispenser for moist towelettes including an open-mouthed container for housing a supply of towelettes and a lid closure which facilitates ready accessibility to a towelette supply. The container is provided with an outwardly extending peripheral flange including front, rear and side sections which define a generally planar surface for receiving the lid in tight fitting engagement. The lid includes a stationary rear portion which overlies the rear flange section of the container, and an integral pivotable front access portion which overlies the interior chamber of the container. Unobstructed access to the entire cross-section of the interior chamber of the container is provided by pivotal movement of the front access portion of the lid.

7 Claims, 5 Drawing Figures

DISPENSER FOR MOIST TOWELETTES

BACKGROUND OF THE INVENTION

This invention relates generally to dispensers for pre-moistened towelettes, and more particularly to a towelette dispenser having an improved lid closure construction designed to facilitate the removal of individual towelettes and maintain the dispenser in a sealed moisture-proof state.

Disposable towelettes fabricated of soft absorbent fibrous materials impregnated with cleansing agents and medicaments are known to the art. Such towelettes are widely used for a variety of personal care and medical purposes.

Pre-moistened towelettes have been introduced in individually wrapped moisture-proof plastic and metal foil packets. Packaging systems of this type have proved satisfactory where towelettes are used in public settings, for example, in restaurants and during travel, where convenience and economy require provision of individually wrapped towelettes. Similarly, in medical applications, individual packaging of towelettes is desirable for purposes of maintaining a sterile dispenser enclosure.

In home care applications, however, where towelettes are used with greater frequency, individually packaged towelettes present several disadvantages and generally have not proved practical. Principally, such systems have not offered ready accessibility to a supply of towelettes. Thus, it will be appreciated that a user must physically tear individual packets with both hands, limiting accessibility to the towelette supply, and the effectiveness of such packaging systems for home care applications. By way of example, in the care of infants, towelettes are used with regularity during feeding and at changing times for cleansing purposes. In such applications, it is most desirable to provide a supply of readily accessible towelettes in a moisture impervious dispenser to permit a user to attend to the infant without interruption.

It is also evident that the cost of individualized towelettes, when used in the home or similar settings, is disproportionately high. For such packaging to be more economical, larger quantities of towelettes must be made available in correspondingly bigger containers.

The prior art and the packaging industry have recognized the need for a dispenser which provides a readily accessible supply of towelettes and has commercialized a variety of moist tissue dispenser systems. In general, however, these systems have not proved entirely satisfactory for facilitating removal of towelettes, and at the same time maintaining the towelette supply in a moisture-proof state for extended periods of time.

Prior art systems directed to the home care market commonly include an open-mouthed container and removable lid having a transversely extending thinned region intermediate the front and rear edges of the lid. This arrangement provides a hinged door portion for access to an interior compartment of the container. Towelettes housed within the container are generally folded into individual napkins which are stacked one on top of the other for individual removal through the top access door. In order to seal the dispenser and prevent loss of moisture from the towelette supply prior to use, known systems also include a removable moisture impervious film or foil which is sealed to the top of the container between the lid closure and container body.

Prior to the first use of the dispenser, the film is removed to provide access to the towelette supply.

One system of this type is exemplified by the teachings of U.S. Pat. No. 3,904,074 to Hoffman, which discloses a dispenser including a container body having an upper lip which defines an opening into an interior chamber, and a removable snapon closure. The closure includes a top wall portion overlying the interior chamber, a downwardly and peripherally extending skirt overlying the outer walls of the container, and an integral flexible transverse hinge intermediate the front and rear ends of the closure. The hinge divides the closure into a stationary rear portion and a forward movable door portion for access to the towelette supply. To prevent the closure from being lifted from the container body, the peripheral skirt of the stationary portion of the cover includes an inwardly directed end projection, and inwardly directed side projections for engaging a peripherally extending shoulder of the container body. To prevent the closure from sliding off the rear of the container body, the cover portion also includes inwardly formed tabs which provide transversely spaced, rearwardly facing shoulders for engaging transversely spaced forwardly facing shoulders of the container body.

Hoffman's dispenser presents several disadvantages associated with the complex structure of the closure and with the position of the intermediate transverse hinge. Fundamentally, difficulties arise from placement of the hinge intermediate the front and rear ends of the closure in a location directly overlying the towelette supply. This arrangement limits accessibility to the towelette supply by partially obstructing access of a user's hand into the dispenser. As the towelette supply is exhausted, the intermediate hinge further impedes removal of towelettes by limiting access to the bottom interior end of the container. Intermediate placement of the hinge also limits the moisture retention effectiveness of the dispenser. In order to permit the hinge to function, Hoffman provides openings in the peripherally extending skirt at opposing ends of the hinge. These openings provide an undesirable passage for air into the chamber housing the towelette supply, resulting in a gradual loss of moisture from within the dispenser.

Finally, in the manufacture of the Hoffman dispenser, it will be appreciated that the lid fastening structure requires the cooperation of inwardly directed end and side projections, inwardly formed tabs and the container shoulders. These fastening features must be fabricated to exacting specifications to provide a secure lid attachment. In the fabrication of the dispenser, it is therefore necessary to employ a plastic having a uniform resiliency, so that the lid flanges and tabs are sufficiently flexible to effect a secure engagement of the lid to the container shoulders.

Another dispenser arrangement of the prior art directed to providing an accessible towelette supply is exemplified by the teachings of U.S. Pat. No. 4,219,129 to Sedgwick. The Sedgwick patent discloses a dispenser including a container for storing a web of absorbent towelette material, and a removable cover having a central frusto-conical dispensing orifice. The web is divided by equally spaced transverse perforated lines to provide separable individual towelettes. The web is encoiled into a roll having a hollow core so that the towelettes may be advanced from the center of the roll without restraint through the dispensing orifice. The configuration of the dispensing orifice provides a "drag" restraining force to cut and facilitate severance of individual towelettes. In order to effect a moisture-proof enclosure, a cap is provided for sealing the dispenser. Although this approach has proved generally satisfactory for providing a moisture-proof closure, the dispenser itself has not proved to be particularly effective. In operation, the dispensing orifice configuration is often found to provide an insufficient restraining force to cause severance of individual towelettes at the lines of perforation in the web. When this occurs, it is necessary for a user of the dispenser to physically grasp the web at a location below a perforation line to prevent further advance of the web and then at the same time to sever a towelette. Aside from being cumbersome in operation, large numbers of towelettes are wasted when severance of a towelette is not effected.

There is thus a need in the part for a disposable towelette dispenser which provides ready accessibility to a towelette supply in a construction which maintains the dispenser in a moisture-proof state for an extended period of time. Such a dispenser should preferably be of uncomplicated design and provide improved manufacturing advantages.

SUMMARY OF THE INVENTION

Accordingly, it is a general purpose of this invention to provide a dispenser for pre-moistened towelettes which includes a container and lid closure construction which facilitates unobstructed access to a housed towelette supply and maintains the container in a moisture-proof sealed state.

A more specific object of the present invention is to provide a dispenser for pre-moistened towelettes including an improved lid fastening structure which provide a more accurate fitment of the lid to the dispenser container in a construction which facilitates ready accessibility to the towelette supply.

Another object of the present invention is to provide a lid fastening structure which engages the open mouth of a dispenser container in a positively locking relation to maintain the container in sealed state and reduce loss of moisture from a housed towelette supply.

Another object of the present invention is to provide a lid fastening structure which cooperates with an integral front access cover portion to provide unobstructed access to an interior chamber within a dispenser.

Yet another object of this invention is to provide a lid closure structure which is of uncomplicated construction and which retains its structural durability and integrity in operation.

A still further object of this invention is to provide a lid closure construction having improved manufacturing advantages by having a less complex structure and by having a lesser need for precise specification tolerances than prior art dispensers.

In the present invention, these purposes, as well as others which will be apparent, are achieved generally by provision of a moisture impervious dispenser for towelettes including an open-mouthed container having a base, an integral peripherally extending enclosing wall, and an open-ended top in communication with an interior chamber for housing a supply of towelettes. The open-ended top includes an outwardly extending peripheral flange having front, rear and side sections which define a generally planar top end surface for receiving a lid closure in tight fitting engagement. The lid has a stationary rear portion which overlies the rear flange section of the container, an integral front access portion which overlies the interior chamber of the container, and a generally transverse hinge positioned generally in overlying relation to the rear flange section.

A means disposed exteriorly to the interior chamber is provided for securing the rear lid portion in fixed locking engagement with the rear flange section of the lid. The exteriorly positioned securing means facilitates positioning of the lid in congruent engagement with the container top to permit maintenance of the container in a closed state. Further means disposed on the front flange section and the lid are provided for removably securing the front access portion of the lid in locking engagement with the open-ended top of the container. Functionally, unobstructed access to the entire cross-section of the interior chamber of the container is provided by pivotal movement of the front access portion of the lid.

In the preferred embodiment of the invention, the lid is provided with an integral depending peripheral skirt for receiving the outer edges of the peripherally extending flange of the container top. In this embodiment, the exteriorly disposed lid securing means includes a plurality of transversely spaced apertures extending through the rear flange section and a plurality of correspondingly spaced cylindrical projections depending from the bottom surface of the rear lid portion. The depending projections are configured so that they may be frictionally force-fit in engagement with the rear flange section apertures to effectively position the lid in overlying and congruent closed engagement with the container top. The front access portion securing means preferably includes a receiving tab extending outwardly from the front flange section of the container top and a lip projecting inwardly from the front section of the peripheral skirt for engaging the receiving tab.

Other objects, aspects, and advantages of the present invention will be apparent when the detailed description of the preferred embodiment of the invention is considered in conjunction with the drawings, which should be construed in an illustrative and not limiting sense, as follows:

DESCRIPTION OF THE PREFERRED EMBODIMENT

Figure 1:
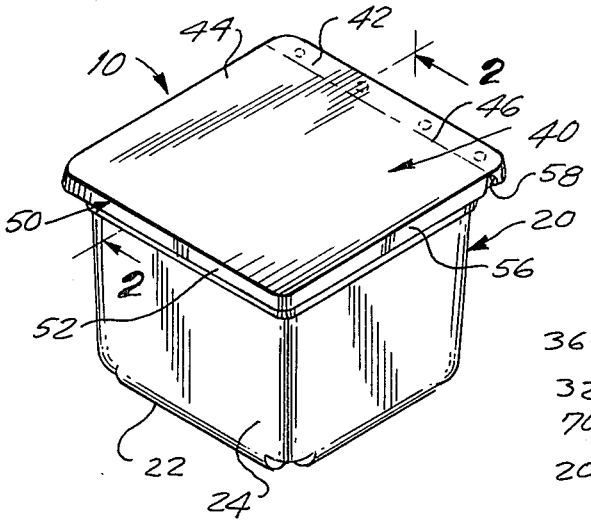
FIG. 1 is a perspective view of a dispenser according to the present invention showing the lid closure overlying the container body.
Figure 3:
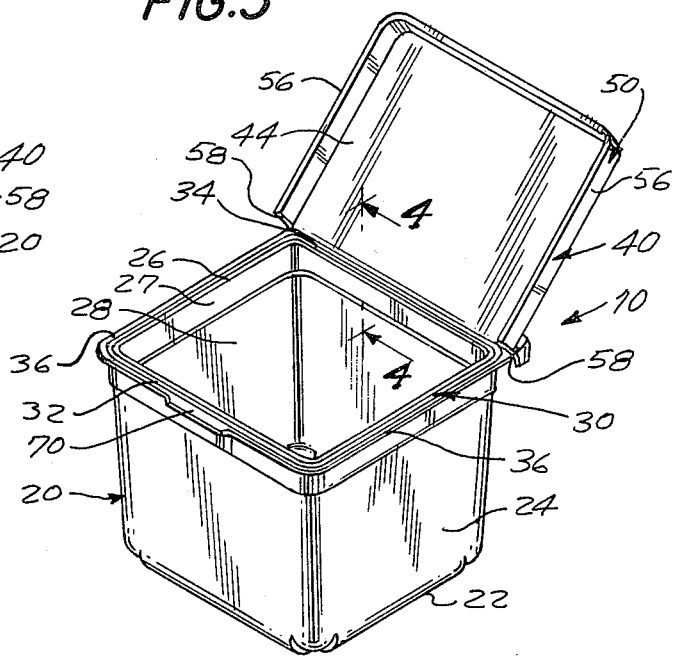
FIG. 3 is a perspective view of the container shown in FIG. 1 with the lid in an open position, illustrating the improved unobstructed access to the interior chamber of the dispenser provided by this invention.

Referring now to the drawings, and, more particularly, to FIGS. 1-4 thereof, a dispenser for pre-moistened towelettes according to the present invention is generally designated 10. The dispenser includes an open-mouthed container body 20, and a lid closure 40. An improved lid fastening structure provides unobstructed access to an interior chamber 28 within the container body 20 to facilitate the removal of towelettes (not shown) housed within the dispenser 10.

Figure 2:
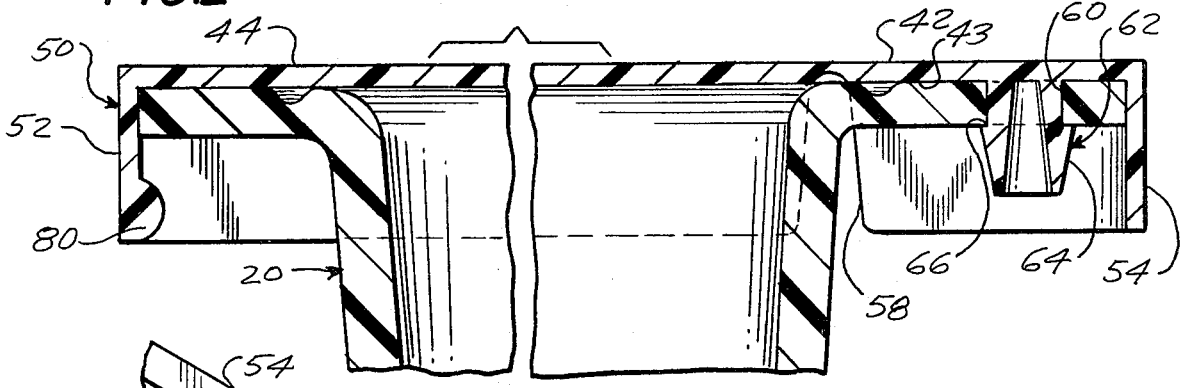
FIG. 2 is a sectional view taken along the line 2—2 of FIG. 1 enlarged in scale to illustrate the lid fastening structure of this invention.

The open-mouthed container body 20, shown in FIGS. 1 and 2, preferably of a rectangular solid configuration, includes a base 22 and an outer enclosing wall 24 extending upwardly and peripherally from the base 22 to define an open-ended top 26 in communication with an interior chamber 28 for housing the towelette supply. The open-ended top 26 includes an outwardly extending peripheral flange 30 having front, rear, and side sections 32, 34 and 36 respectively, defining a generally planar top end surface for receiving lid closure 40. Advantageously, the container body 20 is provided with an enlarged opening 27 at the top end 26 to facilitate removal of towelettes.

Figure 5:
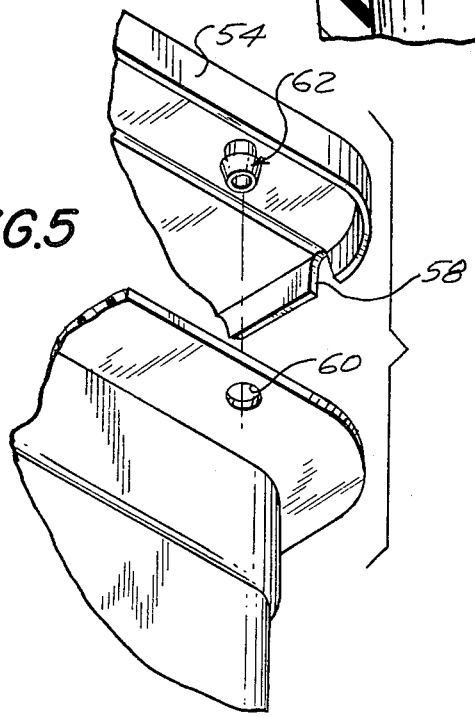
FIG. 5 is a fragmentary perspective view of the lid fastening structure, illustrating the manner in which the depending cylindrical projections of the rear lid portion engage the transversely spaced axial apertures of the rear peripheral flange section of the open ended top of the container body.
Figure 4:
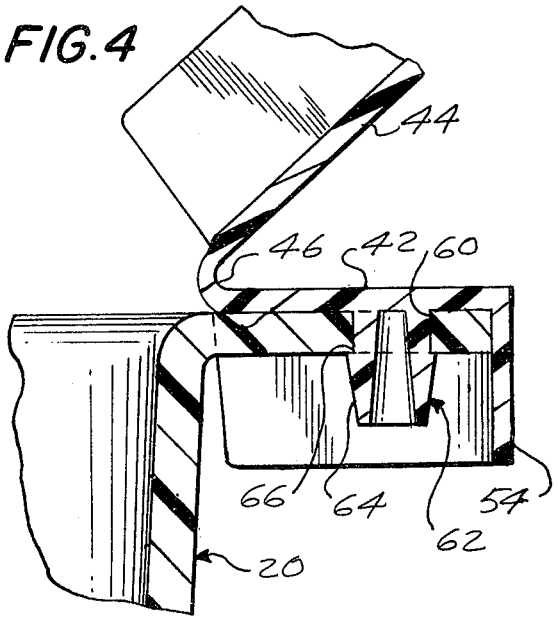
FIG. 4 is a sectional view, taken along lines 4—4 of FIG. 3, enlarged in scale, illustrating the position of the transverse hinge of the lid in general overlying relation to the outwardly extending flange of the open ended top of the container body.

The lid closure 40 includes a stationary rear portion 42 which overlies the rear flange section 34 of the container body 20, an integral front access portion 44 which overlies the interior chamber 28 of the container body 20, and a generally transverse hinge 46 positioned in proximate and overlying relation to the rear flange section 34 of the open-ended top 26 of the container body 20. In the preferred embodiment of the invention, the lid closure 40 is also provided with an integral depending peripheral skirt 50 having front, rear and side sections 52, 54 and 56 respectively, for receiving the outer edges of the peripherally extending flange 30 of the container top 26. The side sections 56 of the peripherally extending skirt 50 are provided with opposing slits 58 positioned in aligned relation with the transversely extending hinge 46 to permit ready pivotal movement of the access lid portion 44 with respect to the integral rear lid portion 42 (see FIGS. 3 and 5).

Exterior of the interior chamber 28, there is provided means for securing rear lid closure portion 42 in fixed locking engagement with the rear container flange section 34. This arrangement securely positions the lid closure 40 in congruent engagement with the container top 26 and permits unobstructed access to the towelette supply through front access lid portion 44. The lid securing means, illustrated in FIGS. 2, 4 and 5, includes a plurality of transversely spaced axial apertures 60 extending through the rear flange section 34 of the open top end 26 of the container body 20, and a plurality of correspondingly spaced cylindrical projections 62 depending from the bottom surface 43 of the rear lid portion 42.

The depending cylindrical projections 62 are configured for frictional force-fit engagement with the spaced axial apertures 60 to lock the rear portion 42 of the lid 40 in engagement with the container top 26. For this purpose, the depending projections 62 are each provided with an annular rim 64 spaced from the bottom surface 43 of the rear lid portion 42 to define circumferential retaining grooves 66. The retaining grooves 66 receive the rear flange section 34 of the open top end 26 of the container body 20 to lock the rear lid portion 42 in engagement with the rear flange section 34. Advantageously, the lid fastening structure including depending cylindrical projections 62 and axial apertures 60 cooperate with front access cover portion 44 and transversely extending hinge 46 to provide unobstructed access to the interior chamber 28 of the container body 20 (see FIG. 3).

Further advantage is obtained by permanently securing the lid 40 to the container body 20 by bonding the depending cylindrical projections 62 to rear container flange section 34. Molding procedures and methods for this purpose are generally well-known in the art; such bonding may, for example, be effected by ultrasonic sealing. Permanent bonding provides greater flexibility in the molding process by limiting the requirement for exacting specifications for the components of the dispenser 10.

A further securing means is providing for removably securing the front access door portion 44 of the lid closure 40 in locking engagement with the open ended top 26 of the container body 20. The front access door portion securing means, illustrated in FIGS. 2 and 3, preferably includes a receiving tab 70 extending outwardly from the front flange section 32 of the open top end 26 of the container body 20, and a lip 80 projecting inwardly from the front section 52 of the peripheral skirt 50 for engaging the receiving tab 70.

The dispenser may be provided with a moisture impervious foil (not shown) for sealing the open-ended top 26 of the container body 20 during the relatively long shelf life required for towelette dispensers prior to their use. The employment of such moisture impervious foils and the method of their construction and application are generally well known in the art. In the dispenser of the present invention, such a foil may be advantageously positioned in overlying relation to the interior chamber 28 of the container body 20 and secured to the planar surface defined by the outwardly extending peripheral flange 30 of the open top end 26 of the container body 20.

From the foregoing, it will be understood that the dispenser 10 may be maintained in a moisture proof hermetically sealed state by provision of a removable moisture impervious foil affixed to the open top end 26 of the container body 20. Prior to initial use the foil is removed to permit access to the towelette supply. The improved lid closure 40 and fastening structure permits a user to obtain access to the entire cross section of the interior chamber 28 of the container body 20. Withdrawal of towelettes is further facilitated by provision of enlarged opening 27 at the top end 26 of the container body 20. When the dispenser 10 is not in use, the lid closure 40 seals the open top end 26 of the container body 20 to provide an extended shelf life for the dispenser 10.

It will be appreciated, therefore, that the present invention provides a dispenser for moist towelettes, which overcomes the difficulties of prior art dispensers and which achieves the objects stated heretofore.

In particular, the present invention provides a towelette dispenser 10 having a lid closure 40 which facilitates unobstructed access to an interior chamber 28 within the dispenser 10 for housing a supply of moistened towelettes. Advantageously, a means disposed exteriorly to the interior chamber 23 of the container body 20 secures a stationary rear portion 42 of the lid 40 in fixed locking engagement with a corresponding rear flange section 34 of the open top end 26 of the container body 20. This facilitates positioning of the lid closure 40 in congruent and closed engagement with the container body 20. A further means disposed on the front flange section 32 and front section 52 of peripheral skirt 50 removably secures a front access portion 44 of the lid 40 in locking engagement with the open ended top 26 of the container body 20. The rear lid portion securing means and the front access door securing means coact to maintain the container body 20 in a sealed state and reduce loss of moisture from the towelette supply housed within the dispenser 10.

More particularly, the firm securement of the rear lid portion 42 to the rear flange section 34 provides a stable arrangement of the lid closure 40 and container body 20 to permit the positioning of tranverse extending hinge 46 in proximate and overlying relation to the rear flange section 34 of the open top end 26 of the container body 20. This provides a lid closure 40 having a front access portion 44 which permits unobstructed access to the entire cross section of the interior chamber 28 of the container body 20.

It should also be noted that advantage is obtained by positioning the slits 58 of the depending peripheral skirt 50 in proximate relation to the rear flange section 34 of the top end 26 of the container body 20 (see FIG. 2). This provides an improved moisture-proof seal of the lid closure 40 with the top end 26 of the container body 20 which is not achieved in prior art dispensers where such slits are positioned intermediate the front and rear enclosing walls of the dispenser in communication with the interior chamber of the dispenser. This prior art arrangement provides an undesirable passage for the entrance of air into the dispenser, resulting in loss of moisture from the towelette supply and a dispenser having a reduced shelf life. In the present invention, this difficulty is avoided by positioning hinge 46 and aligned slits 58 in proximate relation to rear flange section 34, thereby blocking the passage of air through slits 58.

The dispenser 10 also provides decided advantages in the manufacturing process by providing a lid closure 40 having less complex cooperative structural arrangements and a reduced need for precise specification tolerances than in prior art dispensers. Thus, it is more efficient from a cost standpoint to provide a lid closure 40 which is secured in locking engagement with the container body 20 by the force-fit relation of the depending cylindrical projections 62 and correspondingly aligned axial apertures 60, than it is to provide a removable lid in accordance with the prior art including a lid-fastening structure which requires the cooperation of a complicated arrangement of engaging flanges positioned on the dispenser lid and the container body. (See, e.g., U.S. Pat. No. 3,904,074 to Hoffman et al.) Thus, it will be appreciated that the lid fastening features of prior art dispensers must be fabricated by exacting specifications to achieve a secure lid attachment. Also, such dispensers must be fabricated of a plastic having a uniform resiliency to provide a lid fastening structure of defined flexibility to effect a secure agreement of the lid to the container body. The lid fastening arrangement of the present invention including depending cylindrical projections 62 and corresponding axial apertures 60, is not subject to such specification limitations.

Numerous modifications are possible in light of the above disclosure. By way of example, although there has been disclosed a means for securing the stationary rear lid portion 42 and rear flange section 34 in engagement which includes depending cylindrical projections 62 and aligned axial aperatures 60, it will be appreciated by those skilled in the art that other securing means may be provided. Similarly, the present invention is not limited to dispensers of a rectangular solid configuration. A variety of other dispenser configurations may be designed in accordance with the teachings of the present disclosure.

It is to be understood, therefore, that the above described embodiments are merely illustrative and other embodiments may be devised by those skilled in the art, without departing from the spirit or scope of the present invention, as set forth in the appended claims.

There is claimed:

1. A moisture impervious dispenser for housing a supply of towelettes comprising:

an open-mouthed container having an outer enclosing wall defining an interior chamber for housing the supply of towelettes, and an outwardly extending peripheral flange integral with said enclosing wall including front, rear, and side sections defining a generally planar top end surface;

a lid for closing the open-mouth of said container including a rear portion overlying said rear flange section of the container, an integral front access portion overlying the interior chamber of the container, and a generally transverse hinge positioned in proximate and overlying relation to said rear flange section of the container to permit pivotal movement of said front access portion, and unobstructed access to the interior towelette chamber; and means for securing said rear lid portion to said rear flange section including a plurality of transversely spaced apertures extending through said rear flange section, and a plurality of corresponding spaced projections depending from said rear lid portion, said depending projections being frictionally receivable within said spaced apertures to secure said rear lid portion in locking engagement with said rear flange section.

2. A towelette container according to claim 1 wherein said depending projections each include an annular rim spaced from the rear portion of the lid to define a circumferential retaining groove, such that said rear lid portion may be force fit in locking engagement with said rear flange section.

3. A moisture impervious dispenser for housing a supply of towelettes comprising:

an open-mouthed container having a base, and an outer enclosing wall extending upwardly and peripherally from said base, said enclosing wall terminating in an open-ended top in communication with an interior chamber for housing the supply of towelettes, said open-ended top including an outwardly extending peripheral flange having front, rear, and side sections defining a generally planar top end surface;

a lid for closing said open-ended top including a rear portion overlying said rear flange section of the container, an integral front access portion overlying the interior chamber of the container, and a generally transverse hinge positioned in proximate and overlying relation to said rear flange section of the container to permit pivotal movement of said front access portion and unobstructed access to the interior towelette chamber; and means for securing said rear lid portion to said rear flange section including a plurality of transversely spaced apertures extending through said rear flange section, and a plurality of corresponding spaced projections depending from said rear lid portion, said depending projections being frictionally receivable within said spaced apertures to secure said rear lid portion in locking engagement with said rear flange section.

4. A towelette container according to claim 3 wherein said depending projections each include an annular rim spaced from the rear portion of the lid to define a circumferential retaining groove, such that said rear lid portion may be force fit in locking engagement with said rear flange section.

5. A towelette dispenser according to claim 4 wherein said lid includes an integral depending peripheral skirt having front, rear and side sections for receiving the outwardly extending peripheral flange of said container top.

6. A towelette dispenser according to claim 5 further comprising means for removably securing said front access lid portion to the top end of said container, said securing means including a receiving tab extending outwardly from said front flange section of the container top, and a lip extending inwardly from said front peripheral skirt section for engaging the receiving tab.

7. A towelette dispenser according to claim 6 wherein the top end of the container body includes an enlarged opening to facilitate removal of the towelettes.

* * * * *